United States Patent [19]

Hare

[11] 4,289,016

[45] Sep. 15, 1981

[54] AUTOMOBILE FRAME ALIGNMENT APPARATUS

[76] Inventor: Charles E. Hare, 2200 Joppa Rd., Baltimore, Md. 21234

[21] Appl. No.: 60,473

[22] Filed: Jul. 25, 1979

[51] Int. Cl.[3] ..... B21D 1/12

[52] U.S. Cl. ..... 72/457; 72/705

[58] Field of Search ..... 72/705, 457; 187/8.43

[56] References Cited

U.S. PATENT DOCUMENTS

| | | | |
|---|---|---|---|
| 3,222,915 | 12/1965 | Swisher | 72/705 X |
| 3,626,747 | 12/1971 | Rouis | 72/705 X |
| 3,631,705 | 1/1972 | McCaffrey | 72/705 X |
| 3,689,030 | 9/1972 | Backus | 72/705 X |
| 3,690,712 | 9/1972 | Bahrman | 294/82 R |
| 4,055,061 | 10/1977 | Bayorgeon | 72/705 X |
| 4,070,899 | 1/1978 | Venalainen | 72/705 X |

FOREIGN PATENT DOCUMENTS

| | | | |
|---|---|---|---|
| 1053553 | 5/1979 | Canada | 72/705 X |
| 2718241 | 11/1978 | Fed. Rep. of Germany | 72/705 |
| 2745807 | 4/1979 | Fed. Rep. of Germany | 72/705 |
| 2246322 | 5/1975 | France | 72/705 X |
| 294663 | of 1971 | U.S.S.R. | 72/422 |

*Primary Examiner*—Lowell A. Larson
*Attorney, Agent, or Firm*—Horace S. Harper

[57] ABSTRACT

An automobile body frame straightening apparatus is disclosed which includes a stationary elevated ramp to support the automobile at a desired working height, body gripping supports to attach to the undercarriage of the automobile to hold it in a fixed position, and body frame pullers for connecting to a section of the frame or body to be straightened. The body gripping supports connect to the ramp by horizontally reciprocating hydraulic cylinders and beam to move along the sides of the ramp for alignment with the undercarriage of the automobile. Each body gripping support is vertically telescopic and horizontally extendable to align with the undercarriage of the automobile. A ground mounted rail is positioned under the ramp such that a foot element extending from the body gripping support can engage the rail for stability and travel. The body frame pullers are hydraulically operated and move in both the horizontal and vertical directions. One end of each of the body frame pullers is pivotally mounted on a beam support mounted on the floor for movement from in front of the ramp to the side to align with a section of the frame or body to be worked on. A hook and chain fastened to the body or frame and to the body frame puller applies a straightening force on the body frame when the body frame puller is moved horizontally away from the automobile.

9 Claims, 8 Drawing Figures

Fig. 3
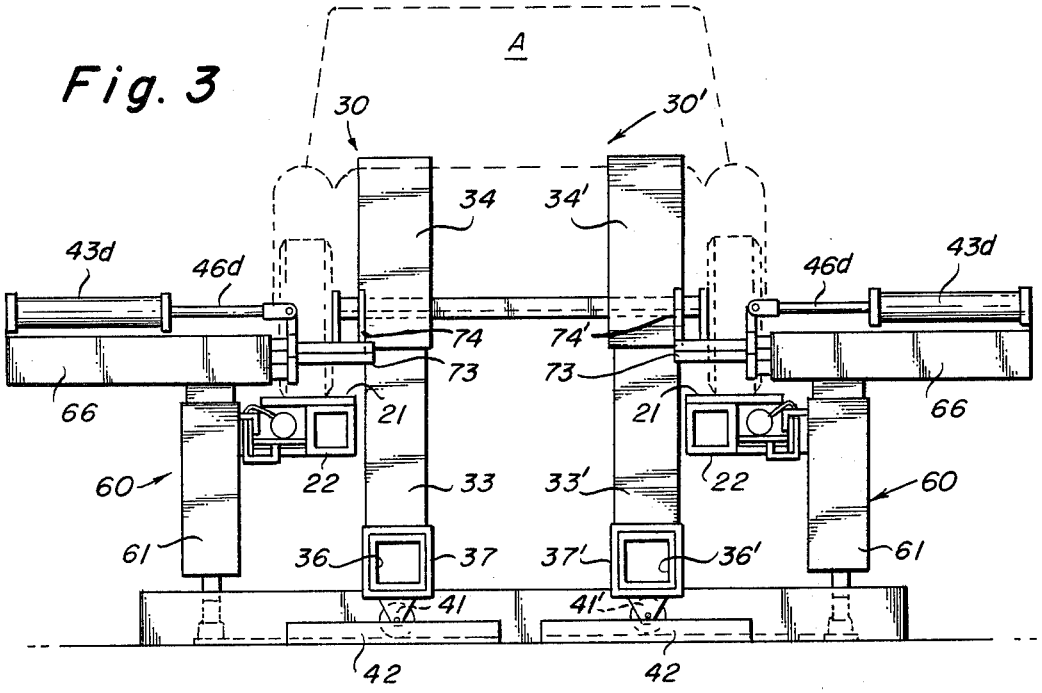
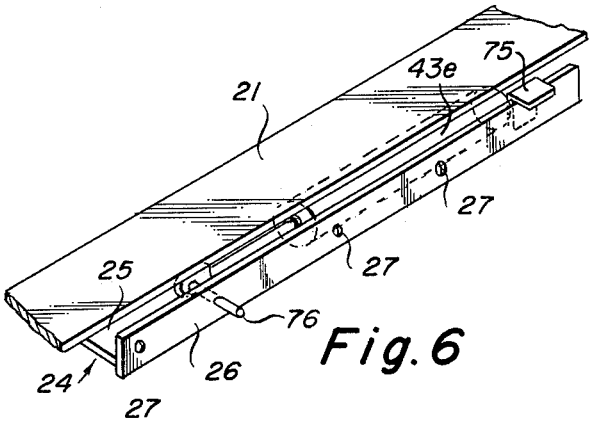
Fig. 6
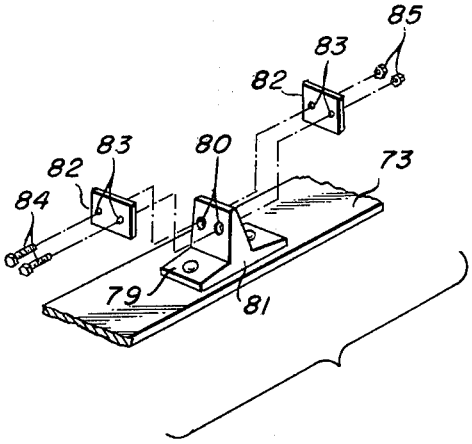
Fig. 7
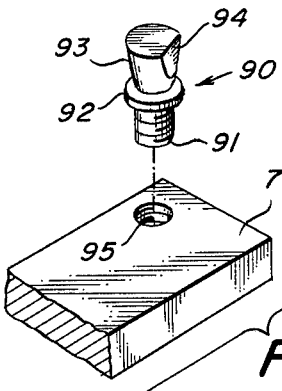
Fig. 8

AUTOMOBILE FRAME ALIGNMENT APPARATUS

BACKGROUND OF THE INVENTION

The present invention relates to an automobile body and frame straightening apparatus for straightening and aligning automobile frames and bodies, in particular to an automobile body and frame straightening apparatus having a hydraulically operated body gripping supports to rigidly hold the automobile body and frame in a fixed position during the straightening and aligning thereof.

Automobile body and frame straightening apparatus have been known for decades, dating back to the very earliest apparatus which required skilled personnel to haul heavy and sometimes awkward equipment from one side of the automobile to the other. Usually the apparatus comprised a rigid stationary ramp frame, either sunk into the floor or ground, or supported above the ground by a base. The automobile was secured to the ramp frame by chains wrapped around any available part such as the axles, bumpers or, if possible, the frame. In turn, a frame puller was attached to the section of the automobile body frame to which a force was applied. The time necessary to set up and straighten an automobile often required two men working together a day or more to complete. Today the same repair can be completed in a third of the time using modern equipment.

Previous body securing devices for holding an automobile against movement included specially constructed posts or trestles bolted directly to the automobile frame. In straightening and aligning to today's modern automobile with unitized construction, it has become necessary for automobile manufacturers to provide specifications on load bearing points on the frame which can be utilized for attaching body securing devices. It is required of all automobile manufacturers to provide for each model and particular body type the number and locations of load bearing points suitable for supporting purposes, particularly on the underside of the bottom plate from which measurements are made to determine the deformations of the body. This replacement is to ensure that the automobile, after straightening and alignment, has regained its original shape corresponding to the drawings, so as to fulfill all traffic safety requirements.

As a result of the requirement to supply detailed information on load bearing points and the number of different types of load bearing points, manufacturers of automobile frame straightening equipment manufacture and market sets of body securing devices for each automobile make, type and model. The economically profitable period for most alignment operations is about 3 to 5 years; therefore, even the larger alignment work shops are limited in the number of opportunities to use the complete line of body frame securing devices. Thus it is obvious that the investment in view of the short useful period makes it impossible for even the best equipped shop to purchase all of the body frame securing devices for each type of automobile. To overcome the problem of carrying a complete line of body frame securing devices, universally adaptable securing devices with clamping jaws which attach to the pinch weld rim along the underside of the automobile, i.e., the so-called rocker panels, was developed. The pinch weld rims have increased strength, because of the need to provide torsional stiffness and load bearing capabilities of the unitized body construction. The pinch weld rims, therefore, can be advantageously used for attachment purposes.

A common difficulty with the previously mentioned securing devices is that several man hours are required to position the securing devices in proper alignment with the automobile frame and the place on the ramp or other stationary hold down apparatus to rigidly support the automobile. At the same time the securing device must be positioned on the automobile at a location which will not interfere with the body frame straightening and alignment operation. The old practice of a chain wrapped around the axle, or frame, or body parts of the automobile and anchored to the ramp is limited in regard to modern alignment operations since quite often the pulling force is applied in a direction not firmly supported. Other prior securing devices which do provide a greater range of automobile support during the straightening operation are often complex to operate.

One of the more recent attempts at a vehicle body and frame apparatus and vehicle body frame securing clamps is shown in Borup, U.S. Pat. No. 4,023,394. The apparatus includes a pair of transverse beams with securing clamps for clamping to the underside of the vehicle body so as to permit these beams to be clamped in horizontal parallel spaced relationship to each other and transversely to the vehicle's longitudinal axis. Each of the beams has supporting wheels to permit raising and moving the vehicle for inserting under the beams a rigid rectangular frame of similar length as the vehicle and lesser width than the length of each of the beams. Clamping bolts join the transverse beams to the rigid frame to provide a rigid structure which in turn supports force-applying apparatus. The Borup apparatus includes slots in the transverse beams and rigid frame for aligning the securing clamps with the vehicle body weld rims and aligning the transverse beams with the rigid frame. This apparatus has certain advantages over prior alignment apparatus, but the set-up time and manual labor required detract from broad acceptance.

U.S. Pat. No. 4,070,899, issued to Venalainen shows an automobile body and frame straightener which secures the automobile against movement during the straightening operation. There is provided a hydraulic assembly with a pivotal lift for raising the automobile to working height. A plurality of clamping devices mounted on transverse beams are manually adjusted to grip the weld rims of the automobile to support it. The only adjustment is along the transverse beams, therefore there is a problem with aligning the automobile frame in relation to the clamping devices if a section of the twisted frame is near a weld rim where the clamping device is located.

Tiedown hooks and chains are shown in U.S. Pat. No. 3,630,066—Chisum where the hooks fasten to the frame and the chain fastens to the ramp. Chisum also discloses body frame pullers pivotally mounted for working on the front and sides of the automobile.

BRIEF DESCRIPTION OF THE DRAWINGS

The invention is illustrated by way of example in the accompanying drawings which form part of this application and in which:

FIG. 3 is a schematic front elevation of the apparatus of FIG. 2;

FIG. 6 is a fragmentary perspective view of one of the ramps of the apparatus according to FIG. 1;

FIG. 7 is a fragmentary perspective view of a preferred body engaging means of the invention; and FIG. 8 is a fragmentary perspective view of an alternative body engaging means of the invention.

DESCRIPTION OF THE PREFERRED EMBODIMENT

Figure 1:
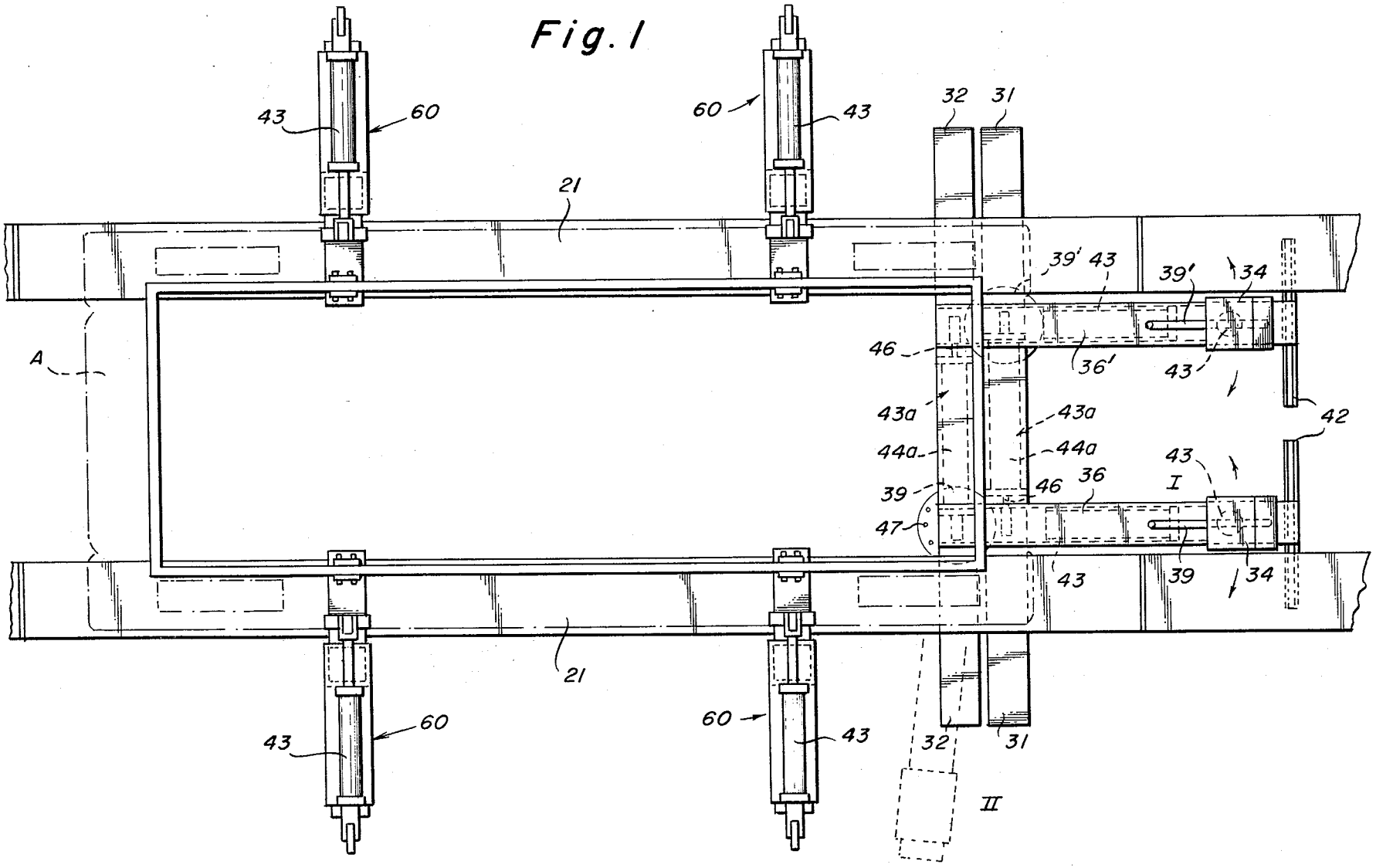
FIG. 1 is a schematic top plan view of an apparatus according to the invention.
Figure 2:
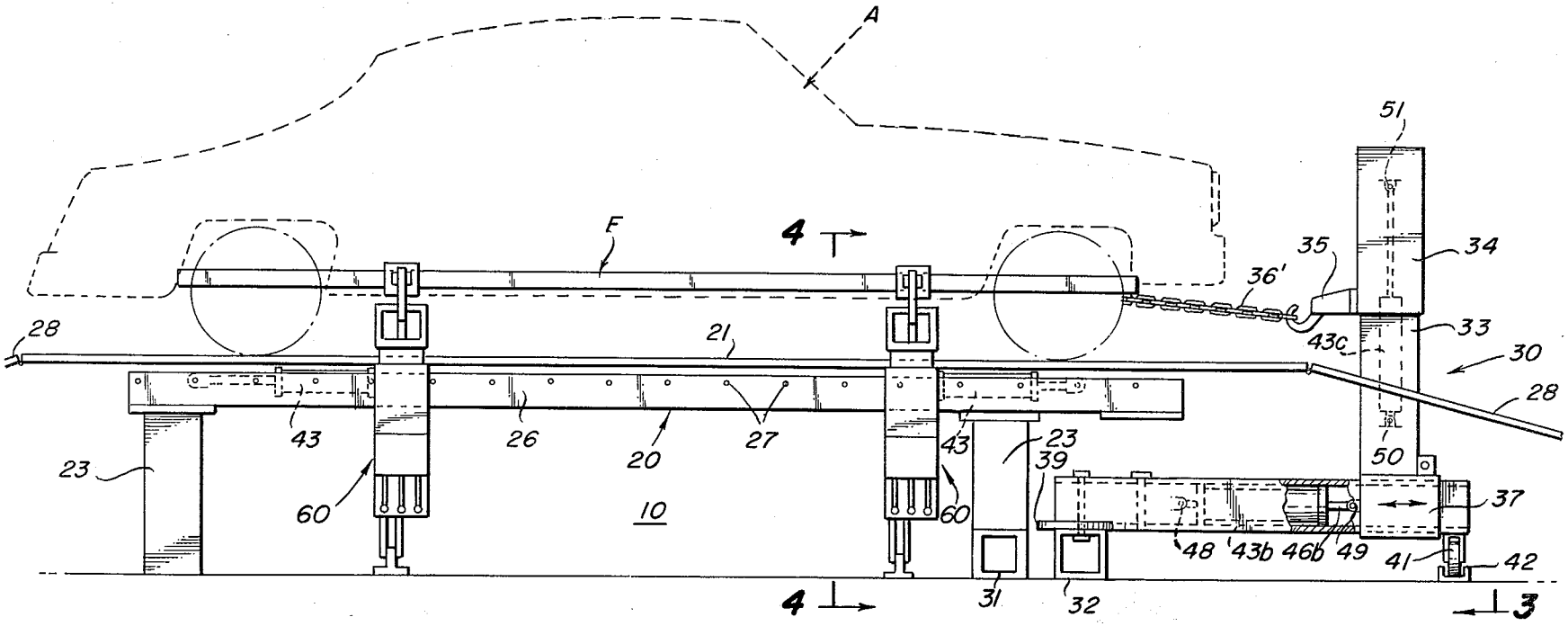
FIG. 2 is a schematic side elevation of the apparatus of FIG. 1 showing in phantom lines an automobile in an elevated position.

Referring now to FIGS. 1 and 2, there is schematically illustrated therein an automobile body and frame straightening apparatus 10 which includes a ramp support means 20, a pair of automobile frame pullers 30, and automobile body gripping supports 60. An automobile A is shown in phantom line on the ramp support means 20 to illustrate the working parts of the automobile body and frame straightening apparatus 10, hereinafter referred to as the body and frame straightener 10.

The ramp support means 20 included a pair of spaced apart ramps 21, which are identical in construction therefore only one will be described. The ramp 21 has a horizontal flat surface on which the automobile A is driven or towed depending upon the type and amount of damage to the body or frame, etc. A beam support 22, shown in FIG. 3, provides structural strength to the ramp 21. The horizontal beam support 22, FIG. 3, is a box construction, however, any suitable structural beam can be utilized, the particular beam structure does not form part of the invention. Vertical beams 23 support the entire assembly in an elevated position above the floor at a desired working height. There is a channel 24 beneath each of the ramps 21 which supports or contains hydraulic cylinder devices 43 that move the automobile body gripping supports 40 (body grippers), which will be explained in detail. The channels 24 include base plate 25 and a side rails 26. There are a plurality of spaced apart aligned holes 27 in the side rails 26 which are used in conjunction with the hydraulic cylinder devices to be discussed. The ends of the ramps 21 are provided with inclined ramps 28 for moving the automobile A onto and off of the ramp 21. These inclined ramps 28 may be removable and interchangable with one another.

At the front end of the ramp support means 20, the automobile body and frame body pullers 30, and 30' hereinafter referred to as frame pullers 30 and 30', are pivotally mounted to support beams 31 and 32. The support beams 31 and 32 are secured to the floor just under the front section of the ramp support means 20 to provide stable fixed ground supports for the body and frame pullers to exert a pushing force against. The frame pullers 30 include a vertical post 33 and 33' with reciprocating sleeves 34 and 34'. Each reciprocating sleeve 34 and 34' has a hook 35 permanently mounted to lower end such that pulling chains 36 may be connected to the automobile or to the automobile body and to the hooks 35 of the frame puller 30 and 30' applies a pulling force to the body or frame. The lower end of the vertical posts 33 and 33' slider sleeves 37 and 37' with openings of sufficient size to just fit on the horizontal beams 36 and 36', respectively, to allow the vertical posts to slide along the horizontal beams.

Looking at FIG. 2, one end of each the horizontal beams 36 and 36' is welded to turntable 39 and 39', respectively which are pivotally mounted on the top surfaces of support beam 21 or 32. Center bolts 40, or similar pivot points connect the horizontal beam 36 and turntable 39 and horizontal beam 36' and turntable 39' to the support beams 31 and 32 respectively. The other ends of the horizontal beams 36 and 36' are provided with pivotal dolly wheels 41 to support the horizontal beams 36 and 36' at the same height from one end to the other. The dolly wheels may ride on a track 42, or on the floor surface. The frame body pullers 30 and 30' are pivoted by hand about the axis of the center bolts 40 and 40' to move from position I to position II of FIG. 1.

A plurality of hydraulic cylinder devices are used to operate the body and frame pullers 30 and 30' and the automobile body gripping supports 60, to be discussed. Each of the hydraulic cylinder devices 43, 43*a*, 43*b*, 43*c* are identical, therefore, any description of a hydraulic cylinder device refers to the same device. It should be understood that the hydraulic cylinder devices are well known and therefore, the exact structure does not form part of the invention. Each of the hydraulic cylinder devices includes a sealed cylinder having a movable piston therein. The piston is connected to a piston rod which extends through one of the ends of the cylinder. There are hydraulic fluid inlet and outlet parts on ends of the cylinder to inject a working fluid to one side of the piston while exhausting it from the other side to cause the piston and piston rod to reciprocate. On the end of the hydraulic cylinder device without the piston rod, there is a support connection for attaching the device to a stationary part of the body and frame pullers 30 and 30' and the automobile body gripping supports 60. The end of the piston rod extending from the hydraulic cylinder device is connected to one of the movable parts of the body and frame puller or to the gripping supports to effect a relative movement between the stationary part and the movable part.

A hydraulic cylinder devices 43*a* is connected to each of the horizontal beams 36 and 36' at the pivotal end to move the body and frame puller 30 in longitudinal slots (not shown) in the top surfaces of the support beams 31 and 32. Therefore, the body and frame pullers 30 and 30' will move across the front end of the ramps 21, with the inclined ramps 28 removed, by reciprocating the piston and piston rod of the hydraulic device 43*a*. The track 42 and dolly wheels 41 keep the body and frame pullers 30 and 30' traveling along a straight line. The longitudinal slots which are not shown, in order to show other parts, extend under the ramps 21 to allow the pullers to be removed to the ends of track 42.

Another of the hydraulic cylinder devices 43*b* is connected to the horizontal beam 36 at 48 and to the vertical post slider 37 at 49 to slide the vertical post 33 along the horizontal beam 36. There is a slot 39 and 39' in each of the horizontal beams 36 and 36', respectively, to connect the slider sleeves 37 and 37', to the vertical posts 30 and 30' to the piston rods 46*b* at 49. The reciprocating or sliding of the vertical posts 33 and 33' in slots 39 and 39' provides the pulling force for straightening or aligning the automobile body and frame F. A third hydraulic cylinder device 43*c* is connected to the stationary vertical posts 33 and 33' 50 and to the sleeves 34 and 34' at 51 to vertically reciprocate the sleeves 34 and 34' on the vertical posts 33 and 33'. The vertical reciprocation of the sleeves 34 and 34' aligns the hooks 35 and 35' at the proper position to provide a pulling force to the body or frame F.

The lever controls and hydraulic hoses from the hydraulic cylinder devices are mounted on a centrally located control panel, not shown, to operate the frame pullers 30 from one position.

Figures 4, 5:
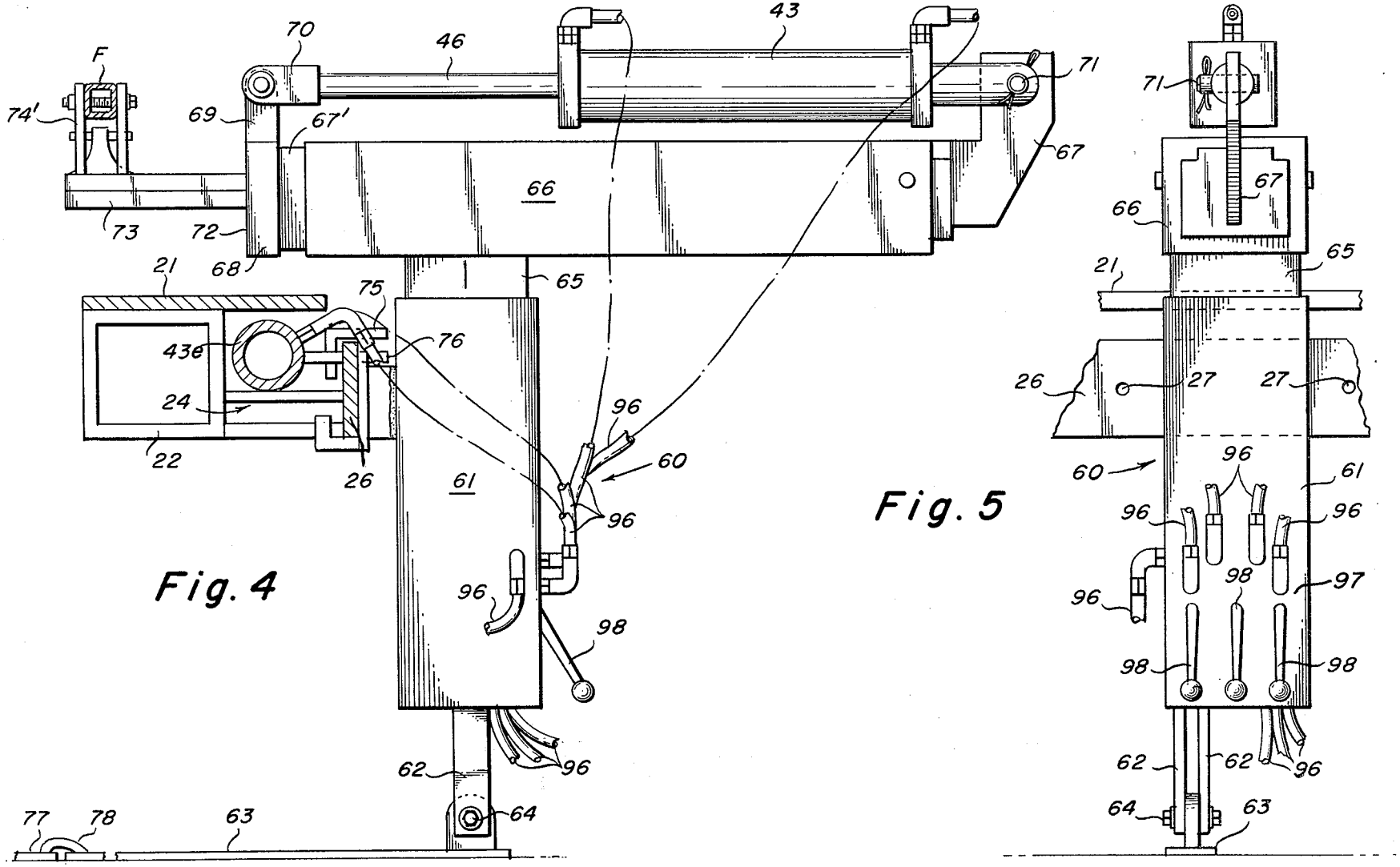
FIG. 4 is a side elevation of an automobile body frame gripper according to the invention.
FIG. 5 is a fragmentary side elevation showing the automobile body frame gripper of FIG. 4.

An automobile body gripping support 60 is shown in FIGS. 4 and 5 which includes a vertically disposed body 61 mounted on a vertical leg 62 with a stabilizer 63, which is connected to the leg 62 by a bolt 64. Telescopically mounted in the body 61 is a vertical post 65 which is connected to a hydraulic cylinder device, not shown. The hydraulic motor would be similar to the cylinder device 43 described earlier. Welded to the vertical post 65 is a horizontal support 66 with an L-shaped bracket 67 mounted at one end. Extendable from the horizontal support 66 is an arm 67 with a bracket 68 welded on the extended end. The bracket 68 has an upwardly projecting connection 69 to which the piston rod end 70 of a rod 46 is connected. The arm 67 is reciprocated into the horizontal support 66 by a second hydraulic cylinder device 43. An automobile clamping device 74 is mounted on the forward end of the arm 67 to connect with the undercarriage of the automobile A.

The body gripper 60 is movable on the side rail 26 of channel 24 by a hydraulic cylinder device 43*d* connected to a support bracket 75 of the body gripper 60. The support bracket 75 is welded to the vertically disposed body 61 at a height to engage on the side rail 26. The bracket is comprised of inverted U-shaped sections which extends about both sides of the side rail 26, such that a cylinder of a hydraulic cylinder device 43*e* will easily connect to the bracket. The piston rod 46*e* of the hydraulic cylinder device 43*e* connects to the side rail 26 through one of the holes 27 by a pin 76.

The stabilizer bar 63 extends under the ramp support means 20 to engage a rail 77 mounted on the floor. The stabilizer bar 63 has a stirrup 78 which fits over the rail 77 for sliding with and guiding the body gripper 60 along the ramp 21. The stabilizer bar 63 prevents the body gripper 60 from moving out of the plane of the rail.

To position the body gripper 60, the vertical post 65 is raised by hydraulics above the level of the ramp 21 and the body gripper 60 is slid along side rail 26 by hydraulic motor 43 to the load bearing point weld rim on the automobile undercarriage. The arm 73 is positioned beneath the load bearing point by operating the hydraulic motor 43 mounted on horizontal support 66 to extend the sleeve 67 and arm 73. The vertical post 65 is then raised to a height where the clamping device 74 can be connected. In moving the body gripper 60 care must be taken to guide the stirrup 78 along rail 77 since the stirrup 78 cooperates with the rail to stabilize the body gripper.

The clamping device 74 is best shown in FIG. 7 where a section of the body gripper arm 73 is shown with a T-shaped bracket element 79 bolted to it. The T-shaped bracket element 79 is provided with holes 80 in the upstanding leg 81. As shown in FIG. 7, the upstanding leg 81 is wedged shaped, with the narrowest portion at the top of the leg; therefore, when pair of clamps 82 are bolted to T-shaped bracket element 79 through holes 80 in the bracket 79 and holes 83 in the clamps 82 by bolts 84 and nuts 85 the ends of the clamps will form a vise-like device to grip the frame of an automobile. In FIG. 4, another embodiment of the clamp 74' is shown where the clamps are bolted directly to the Frame F.

In use the clamping device 74 is designed to clamp to the weld rim of an automobile undercarriage. When the body grippers 60 are positioned and clamped to the automobile undercarriage there is virtually no body movement, even when a pulling force is applied to the frame F.

Some modern automobiles are assembled on full frame, as opposed to unitized construction. These automobile frames are provided with load bearing ports instead of weld rims. Therefore, the clamping device 74 will not work properly. To support the full frame automobile a peg 90 is provided. The peg 90 is shown in FIG. 8 with a threaded end 91, a collar 92 and an inverted frusto conical end 93. There is a flat surface 94 on the frusto conical end 93 which aids in inserting the peg 90 in a load bearing port.

To accommodate the peg 90, the arm 73 of the body gripper 60 is provided with a threaded hole 95. To insert the peg 90, the body gripper 60 is positioned, as previously stated. With the peg 90 aligned under a load bearing port, the vertical post 65 is raised to insert the peg 90. Any problem of alignment of the peg 90 is easily compensated by moving the arm 73, and with the aid of the flat surface 94 on the peg, guiding the peg into the hole.

Hydraulic hoses 96 connect to the hydraulic motor 43 and to a control panel 97 on the front of the vertically disposed body 61, as shown in FIG. 5. There are connections and valves in the hydraulic lines which are not shown. It should be understood that the hydraulic cylinder devices; hydraulic lines and control levers are conventional and therefore the type of hydraulic system forms no part of this invention.

In the description the various details described and shown are only illustrative of the inventive concept. Various embodiments of the invention, of course, may vary within the scope of the specification therefore the invention should be viewed by the claims.

What is claimed is:

1. An automobile body and frame straightening apparatus comprising:

an elevated ramp support means for supporting an automobile above the ground;

a plurality of automobile body frame support means to rigidly support the automobile against movement while being repaired; and at least two automobile body and frame pullers for straightening the body and frame of an automobile;

said ramp support means having a top surface, a pair of sides, first and second ends, and a pair of channel means to support said automobile body frame support means, said channel means positioned under said ramp means top surface and on said sides of said ramp means;

said automobile body frame support means including a channel means supported body, a vertically telescopic means in said body and a horizontally telescopic means supported on said vertically telescopic means, a clamp means on said horizontally telescopic means for engaging and rigidly supporting said automobile frame against movement, where said vertically telescopic means raises said horizontally telescopic means to the height of the automobile frame and said horizontally telescopic means moves said clamp means into position to engage the automobile frame, a ground engaging means on said body means to stabilize said automobile body frame support means;

said automobile body and frame puller means including at least one ground support under said first end of said ramp support means, a horizontal beam member pivotally mounted on said ground support means for movement along said first end and along at least one side of said ramp support means, a vertical body member slidable on said horizontal beam member to apply a pulling force to said automobile body and frame, a vertically telescopic member in said vertical body member having means to connect to said automobile body and frame to pull on the damaged area of the automobile, where said horizontal beam member is moved along said ground support means and pivoted to align with the damaged area, and said vertically telescopic member is aligned and connected with the damaged area prior to said vertical body member applying a pulling force to said damaged automobile body and frame.

2. An automobile body and frame straightening apparatus as in claim 1 wherein said channel means have side rails on which said body frame support means slides to align with the automobile frame, and hydraulic means in said channel means to slide said body frame support means on said side rails.

3. An automobile body and frame straightening apparatus as in claim 2 wherein said vertical body members of said automobile body and frame pullers include a sleeve member for sliding on said horizontal beam member, said sleeve member being connected to a hydraulic driven means affixed in said horizontal beam member for horizontally reciprocating said vertical body member on said beam member to apply a substantially horizontal pulling force to said damaged automobile body and frame.

4. An automobile body and frame straightening apparatus as in claim 3 wherein said vertically telescopic member in said vertical body member is connected to a hydraulic driven means affixed in said vertical body member to telescope said vertically telescopic member to a position to apply a substantially horizontal pulling force to said damaged automobile body and frame.

5. An automobile body and frame straightening apparatus as in claim 4 wherein said floor engaging means having a stabilizer bar means which extends beneath said ramp support means, and a rail means mounted to a floor surface where said floor engaging means rides on said rail means.

6. An automobile body and frame straightening apparatus as in claim 5 wherein said ramp support means having a means for sliding said body and frame support means on said ramp support means.

7. An automobile body and frame straightening apparatus as in claim 6 wherein said clamping means for clamping to said automobile having an inverted T-shaped bracket removable mounted on said horizontally telescopic means, said clamping means including a pair of tightenable clamps bolted to said inverted T-shaped bracket whereby said clamps engage the automobile frame and rigidly support the frame against movement.

8. A body frame support gripping device for use with an automobile body and frame straightening apparatus having a channel means on the sides of the ramps for elevating an automobile above the ground comprising:

at least one body member slidably supported on said channel means to travel horizontally along the sides of the ramp means;

a vertically telescopic means in said body member and hydraulic driven means in said body member to telescope said vertically telescopic means;

a horizontally telescopic means extending from said vertically telescopic means to extend under said automobile frame;

a clamping means on said horizontally telescopic means for engaging and rigidly supporting said automobile frame against movement;

a first hydraulic driven means affixed in said body and connected to said vertically telescopic means to raise said horizontal means to the height of said automobile frame;

a second hydraulic driven means on said horizontally telescopic means to move said clamping means into position to engage and support the automobile frame rigidly against movement.

9. A body frame gripping support device as in claim 8 including a clamp means for clamping to an automobile having an inverted T-shaped bracket removably mounted on said arm, said clamp means including a pair of tightenable clamps bolted to said inverted T-shaped bracket.

* * * * *